United States Patent [19]

Finney

[11] 4,187,835

[45] Feb. 12, 1980

[54] INDIRECT HEAT TRANSFER APPARATUS

[75] Inventor: Geoffrey L. Finney, Sutton Coldfield, England

[73] Assignee: Dunlop Limited, London, England

[21] Appl. No.: 874,317

[22] Filed: Feb. 1, 1978

[30] Foreign Application Priority Data

Feb. 4, 1977 [GB] United Kingdom ..... 4589/77

[51] Int. Cl.[2] ..... F24H 1/20

[52] U.S. Cl. ..... 126/360 R; 126/91 A; 431/352

[58] Field of Search ..... 126/360 R, 360 A, 91 A, 126/91 R; 431/352, 353

[56] References Cited

U.S. PATENT DOCUMENTS

| | | | |
|---|---|---|---|
| 2,226,816 | 12/1940 | Hepburn | 126/91 A |
| 3,828,762 | 8/1974 | Duzey | 126/91 A |
| 4,014,316 | 3/1977 | Jones et al. | 126/360 R |
| 4,044,683 | 8/1977 | Ostroff | 431/352 |

*Primary Examiner*—Samuel Scott
*Assistant Examiner*—Wesley S. Ratliff, Jr.
*Attorney, Agent, or Firm*—Stevens, Davis, Miller & Mosher

[57] ABSTRACT

In a tank immersion heating system a conical casing surrounds the high intensity fuel burner with its narrower end communicating with the immersed tube to introduce combustion air with progressively increasing velocity so that although flame "lift-off" is avoided combustion takes place mainly within the tube.

14 Claims, 4 Drawing Figures

INDIRECT HEAT TRANSFER APPARATUS

The present invention relates to improvements in indirect heat transfer apparatus and more particularly to apparatus comprising a tube through which combustion gases from a fuel burner are passed so that heat is transferred through the tube wall to a fluid in which the tube is immersed. When the fluid to be heated is a liquid the apparatus is known as a tank immersion heater, the tube being arranged in a sinuous path in the tank below the level of the liquid in the tank with its two ends extending through the tank wall. A fuel burner such as a gas burner is connected to one end of the tube and a flue is connected to the other end of the tube to carry away exhaust gases. The fuel is mixed with air at the burner and the combustible mixture is ignited downstream of the burner.

It is desirable to use for a tank immersion heating system a high intensity burner, meaning one having a heat release in excess of 50,000 British Thermal Units per square inch of the cross-sectional area of the tube.

However, it is desirable that the immersed tube should be of small bore, meaning not more than 4" in diameter. It should also preferably be a long tube, i.e. having a length to diameter ratio of at least 25:1. A characteristic of a high intensity burner is that air is introduced under pressure (either by pressurizing the air upstream of the burner or producing suction downstream of the burner, or both). It is not practicable to introduce the air through a pipe surrounding the burner and less than 4" in diameter because the velocity of the air passing the burner to enter the flame would be too great resulting in an unstable flame and the phenomenon known as "lift-off" in which the burner is effectively blown out. Therefore the burner cannot be located directly within the immersed tube although this would clearly be the optimum arrangement to prevent dissipation of heat outside the tank.

Another problem which would arise if a way were found of firing the burner directly into the tube is so-called "flame chilling". If the flame is exposed to a cold heat-exchanger too early in the combustion process combustion is incomplete.

One solution to these problems is to burn the mixture in a combustion chamber, the combustion chamber being of larger internal diameter than the immersed tube and communicating therewith at its end remote from the burner. If the combustion chamber is located outside the tank and is of refractory material, however, there will be some loss of radiated heat outside the tank, the combustion chamber represents an additional expense, occupies additional space and represents a safety hazard since this very hot component is outside the tank where it may be accidentally touched or suffer damage.

A principal object of the present invention is to enable a high intensity fuel burner to be used in connection with a small bore immersed tube without the necessity for an interposed combustion chamber and whereby at least the greater part of the combustion will take place within the immersed tube.

In accordance with the present invention there is provided indirect heat transfer apparatus in which fuel is progressively mixed with air in a burner assembly, the burner being of the "high intensity" type (as herein defined) and burning gases are discharged into a small bore tube (as herein defined) immersed in a fluid to be heated whereby heat is transferred through the tube wall from the combustion gases to the fluid, wherein combustion air is admitted under pressure through a casing connected to the tube which at a position near the burner is of greater cross-sectional area than the tube but which progressively reduces in cross-sectional area toward the tube in such a way that the velocity of the combustion air is progressively increased between the burner and the tube, in a manner so that said velocity is low enough to provide flame stability at the burner but progressively increases in such a way that a higher proportion of the combustion takes place within the tube than within the casing.

Preferably the casing comprises a truncated conoidal annulus the larger-diameter end portion of which surrounds the burner and the smaller diameter end of which is connected to the tube. The cone preferably has a total included angle in the region of 20°.

An apertured tubular sleeve preferably extends between the burner and the tube within the casing so that combustion air passes through the apertures in the shield.

The casing and tube are preferably interconnected by an outwardly directed flanged connection which serves also for mounting the assembly in an aperture in a tank wall.

Means may be provided in the tube at a position spaced therealong from the burner for creating a suction. effect in the tube which will draw the burning gases thereinto, thereby inducing the combustion air supply. The suction-producing means may be a compressed air nozzle co-axially disposed in the tube and directed away from the burner along the tube, or it may be a Coanda inducer coaxially disposed in the tube and directed so that the flow of fluid from the inducer is away from the burner along the tube, or a fan may be used to produce suction in the tube.

Preferred embodiments of the present invention will now be described with reference to the accompanying drawings, in which.

Figure 1:
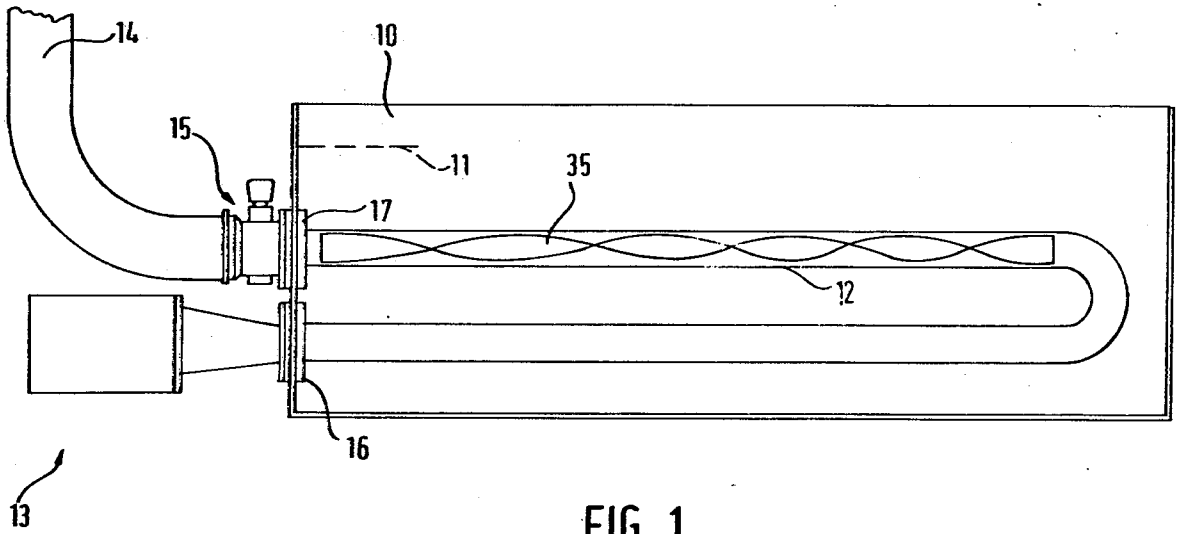
FIG. 1 is a side sectional elevation of a tank immersion heating system in accordance with the present invention.

The apparatus illustrated in FIG. 1 comprises a tank 10 which can be filled with a liquid to be heated approximately to the level 11. Below the level 11 a sinuous (in this case 'U'-shaped) tube 12 is located in the tank with its two ends in register with respective apertures in one wall of the tank. A high intensity fuel gas burner assembly generally indicated at 13 is located outside the tank in communication with one end of the tube 12, the other end of the tube 12 communicating with a flue 14 outside the tank via a suction producing device generally indicated at 15 and also located outside the tank. The tube and the burner assembly and the tube and the suction producing device are fastened together and to the tank wall by means of radially extending flanges 16 and 17 adapted to form a liquid-tight seal with the tank wall and in the case of the flanged connection 16 serving also to protect the tank wall from the heat of the burner assembly and the admission end of the immersed tube. If the tank is of a material particularly vulnerable to heat, such as glass-reinforced plastics material, the radial extent of the flanges 16 can be enlarged or they may be replaced by a relatively thin metal diaphragm (not shown). Other measures which may, if necessary, be taken to protect the tank wall from the heat of the burner assembly include the provision between the burner assembly and the tank wall of a collar (not shown) which may be provided with radially extending fins to dissipate the heat.

The burner assembly 13 comprises a gas burner 18 mounted on the end of a gas inlet pipe 19. The burner 18 is preferably of the "matrix" type described in the Complete Specifications of British Pat. Nos. 1,325,443 and 1,360,796, and is provided with air admission apertures (not shown) whereby primary air is admitted, mixed with gas from the pipe 19 and the mixture is ignited downstream of the burner 18 where secondary air admitted around the burner 18 is supplied to the flame.

In accordance with the present invention, secondary air is admitted through a casing 20 in the form of a truncated conoidal annulus, the narrower diameter end of which is of approximately the same diameter as the tube 12 and connected thereto by the flanged connection 16 while the wider diameter end of the casing 20 co-axially surrounds the burner 18. The shape of the casing 20 is so calculated that there is a progressive increase in the velocity of the admitted air from a relatively low level near the burner 18 to a relatively high level near the admission end of the tube 12, the arrangement being such that nearer the burner the velocity of the secondary air is low enough to avoid lift-off while ensuring a stable flame but the progressive acceleration of the secondary air toward the tube 12 ensuring that the burning mixture is carried into the tube 12 before a high proportion of the combustion has taken place within the casing 20. By this means it is ensured that the greater part of the combustion takes place within the tube 12 with the result that the casing 20 is exposed to relatively little of the heat output of the burner. The casing 20 is in any case cooled by the incoming secondary air and a combination of these factors ensures that the burner assembly 13 outside the tank operates without reaching a high temperature with consequent waste of heat. The fact that there is no very hot component outside the tank 10 also represents a safety feature of the equipment.

As is known per se, the burner 18 has a frusto-conical shield 21 which delays the introduction of the secondary air and this is located coaxially within the casing 20 in inverted relation thereto. From the larger diameter end of the shield 21 an apertured sleeve 22 extends to the inlet end of the tube 12 so that the secondary air reaches the flame through the apertures 23 in the sleeve. It will be evident that, if necessary, the rate of admission of secondary air to the flame can be varied by varying the dimensions and distribution of the apertures 23 along the length of the sleeve 22.

Figure 3:
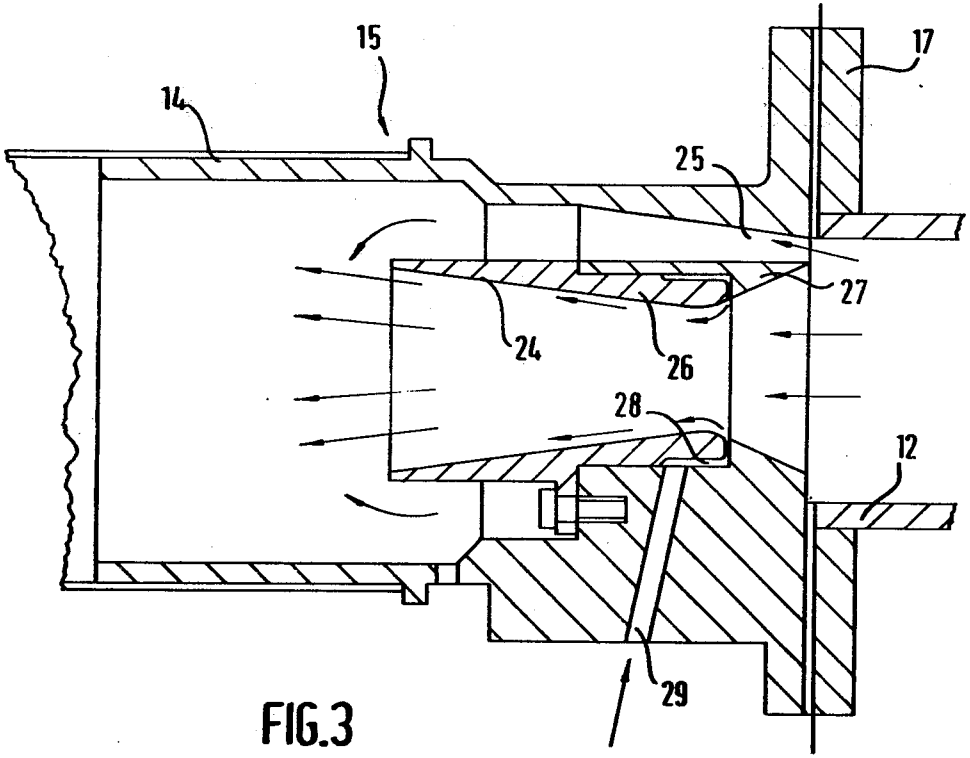
FIG. 3 is a side sectional elevation on an enlarged scale of the Coanda inducer of the system of FIG. 1.

The extraction means 15, shown in more detail in FIG. 3, connected to the outlet end of the tube 12 is in the form of a Coanda inducer the annular core 24 of which is located co-axially within a portion of the flue 14 which forms therewith a venturi 25. The core 24 is in two telescopic sections 26 and 27 which define therebetween an annular air passage 28 to which air under pressure is supplied through a radial pipe 29 in the portion 27. The end of the portion 26 nearer the portion 27 has a rounded inner periphery to induce air flowing from the passage 28 to flow in the direction of the flue 14 away from the tube 12 thereby tending to create suction upstream of the device 15 which causes combustion gases from the tube 12 to pass to the flue 14 both around the core 34 through the venturi 25 and through the core 24.

Figure 4:
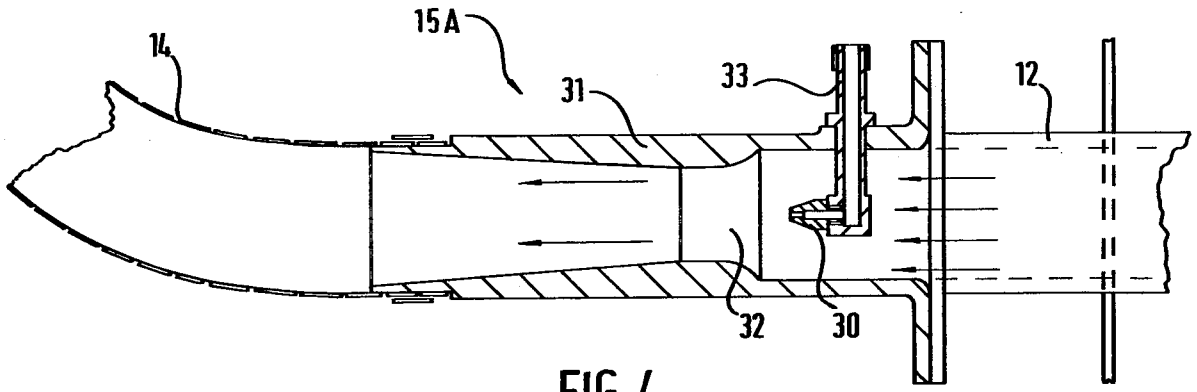
FIG. 4 is a view similar to FIG. 3 of an alternative means for producing suction within the immersed tube.

As an alternative to the arrangement of FIG. 3 the device 15 may be replaced by the device 15A shown in FIG. 4 in which the Coanda inducer is replaced by a compressed air nozzle 30 located co-axially within a portion 31 of the length of the flue 14 which defines a venturi 32 downstream of the nozzle 30. The nozzle 30 is mounted on a supply pipe 33 radially penetrating the portion 31. The admission of compressed air to the nozzle 30 through the pipe 33 induces the flow of combustion gases from the tube 12 through the venturi 32 in such a way as to create suction in the tube 12.

Suction may be produced at the outlet end of the tube 12 in any other known and suitable manner. For example an extractor fan may be used for this purpose.

It will be understood that the effect of the operation of the device 15, or one of the alternatives thereto described, is to create a forced draft of the incoming primary and secondary air to the burner assembly 13 as well as to promote movement of the combustion gases along the length of the tube 12. Reliance may be placed entirely on such suction producing means for this purpose or it may be replaced by means (not shown) introducing air under pressure into the casing 20 upstream of the burner 18, or a suitable combination of both pressure and suction may be used to introduce the combustion air under pressure and to displace the combustion gases along the length of the tube 12.

Figure 2:
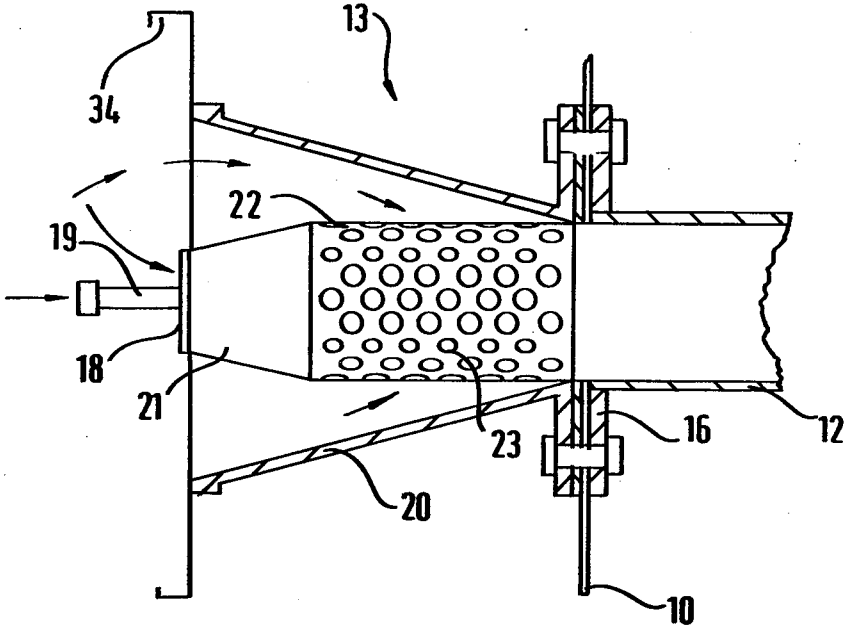
FIG. 2 is a side sectional elevation on an enlarged scale of the burner of the system of FIG. 1.

The casing 20 is preferably connected to a sound attenuator or silencer indicated schematically at 34 in FIG. 2 and located upstream of the burner 18.

To promote heat exchange between the combustion gases and the wall of the tube 12 a flat strip of metal 35 twisted about its axis may be located at least in a terminal portion of the length of the tube 12 whereby the combustion gases are forced to follow a helical path within the tube 12.

What we claim is:

1. Indirect heat transfer apparatus in which fuel is progressively mixed with air in a high intensity burner assembly and burning gases are discharged directly into a tube of relatively smaller diameter immersed in a fluid to be heated whereby heat is transferred through the tube wall from the combustion gases to the fluid, and combustion air is admitted under pressure through a casing connected directly to the tube which at a position near the burner is of greater cross-sectional area than the tube but which progressively reduces in cross-sectional area toward the tube in such a way that the velocity of the combustion air is progressively increased between the burner and the tube, in a manner so that said velocity is low enough to provide flame stability at the burner but progressively increases in such a way that a higher proportion of the combustion takes place within the tube than within the casing.

2. Apparatus as claimed in claim 1, wherein the casing comprises a truncated conoidal annulus the larger-diameter end portion of which surrounds the burner and the smaller diameter end of which is connected to the tube.

3. Apparatus as claimed in claim 2 wherein the cone has a total included angle in the region of 20°.

4. Apparatus as claimed in claim 1 wherein an apertured tubular sleeve extends between the burner and the tube within the casing so that combustion air passes through the apertures in the shield.

5. Apparatus as claimed in claim 1 wherein the casing and tube are interconnected by an outwardly directed flanged connection which serves also for mounting the assembly in an aperture in a tank wall.

6. Apparatus as claimed in claim 1 wherein means is provided in the tube at a position spaced therealong from the burner for creating a suction effect in the tube which will draw the combustion gases thereinto, thereby inducing the combustion air supply.

7. Apparatus as claimed in claim 6, wherein the suction-producing means is a compressed air nozzle coaxially disposed in the tube and directed away from the burner along the tube.

8. Apparatus as claimed in claim 6, wherein the suction-producing means is a Coanda inducer co-axially disposed in the tube and directed so that the flow of fluid from the inducer is away from the burner along the tube.

9. Apparatus as claimed in claim 6, wherein the suction-producing means is a fan.

10. Apparatus as claimed in claim 1 wherein means is provided for pressurizing the combustion air upstream of the burner assembly.

11. Indirect heat transfer apparatus having an immersion tube for heating liquid in a tank and a high intensity burner assembly connected directly to one end of the tube without an interposed combustion chamber so as to facilitate combustion taking place within the tube, said burner assembly comprising:

(a) a conical casing having its larger end remote from the tube and progressively reducing in cross-sectional area toward said tube to a diameter approximately equal to that of the tube and directly connected thereto;

(b) a gas burner concentric within the conical casing and directed toward the tube, the space directly between the burner and the tube being free of intermediate flame diverging structure so that the flame from the burner can freely enter the tube;

(c) means to supply combustion air under pressure to the conical casing, the shape of the conical casing being such that the velocity of the combustion air progressively increases so that a higher proportion of the combustion takes place within the tube within the casing.

12. The apparatus of claim 11 including a generally cylindrical apertured tubular sleeve between the burner and the tube and positioned so that combustion air passes through the apertures.

13. The apparatus of claim 12 in which said sleeve has, at its end adjacent the burner an outwardly tapered shield portion to protect the flame from lift-off.

14. Indirect heat transfer apparatus in which a burner for fuel and air of the "high intensity" type (as herein defined) discharges into a tube which has a casing section around the burner and a section of small bore (as herein defined) which, in use, is immersed in the fluid to be heated, the casing section being of greater diameter than the small bore section in the region of the burner and being constructed and arranged so that at least the greater part of the combustion takes place within the portion of the length of the tube which is immersed, in use.

* * * * *